US006345995B1

(12) United States Patent
Bigotto et al.

(10) Patent No.: US 6,345,995 B1
(45) Date of Patent: Feb. 12, 2002

(54) ELECTRIC CONNECTOR

(75) Inventors: Pier Carlo Bigotto, Cascine Vico Rivoli; Renzo Rampone, Moncalieri, both of (IT)

(73) Assignee: Framatome Connectors International, Courbevoie (FR)

( * ) Notice: Subject to any disclaimer, the term of this patent is extended or adjusted under 35 U.S.C. 154(b) by 0 days.

(21) Appl. No.: 09/448,006

(22) Filed: Nov. 23, 1999

(30) Foreign Application Priority Data

Nov. 29, 1999 (IT) ..... TO98A1002

(51) Int. Cl.[7] ..... H01R 13/62; H01R 13/64
(52) U.S. Cl. ..... 439/157; 439/372
(58) Field of Search ..... 439/157, 372

(56) References Cited

U.S. PATENT DOCUMENTS 5,681,175 A * 10/1997 Busse et al. ..... 439/157
5,876,226 A * 3/1999 Tsukakoshi et al. ..... 4439/157
6,019,620 A * 2/2000 Kodama et al. ..... 439/157

FOREIGN PATENT DOCUMENTS

EP 0363804 A1 4/1990
EP 0726617 A2 * 11/1996 ..... H01R/13/629

* cited by examiner

*Primary Examiner*—Paula Bradley
*Assistant Examiner*—Edwin A. León
(74) *Attorney, Agent, or Firm*—Perman & Green, LLP

(57) ABSTRACT

An electric connector (2) having an insulating casing (5) with a number of cavities for respective electric terminals (4); a slide (15) movable with respect to the casing (5) in a direction perpendicular to the connection direction (A) of the terminals (4), and in turn having cam means (20) interacting with a complementary connector (3) to generate a force for mating the connectors (2, 3) in response to translation of the slide (15); and an activating lever (24) connected in articulated manner to the slide (15) and to the casing (5) by means of pins (27, 36) which engage respective slots (29, 35) in sliding manner to impart a translatory component of motion to the lever (24), and to vary the resisting arm of the lever (24) during rotation of the lever (24).

7 Claims, 5 Drawing Sheets

ELECTRIC CONNECTOR

The present invention relates to an electric connector for a connecting unit having a large number of ways, and particularly, but not exclusively, for a connecting unit of the type used to connect an electronic central control unit to a vehicle electric system.

Electric connecting units are known which substantially comprise a plug connector having a number of electric terminals; and a socket connector having a number of complementary electric terminals cooperating with respective electric terminals of the plug connector when the two connectors are mated. In the example application mentioned above, the plug connector is connected to a bundle of cables forming part of the vehicle wiring, while the socket connector is conveniently integrated in the central control unit.

As is known, the force required to mate the connectors increases in direct proportion to the number of electric terminals of the connectors, and, in fact, mainly equals the sum of the forces required to insert each of the terminals inside the respective complementary terminal.

Electric connecting units are known which comprise a lever device for reducing the manual force required and ensuring accurate guidance to mate the connectors.

EP-A-0 363 804 illustrates a connecting unit featuring such a device, and wherein one of the two connectors carries a slide movable in a transverse direction with respect to the connection direction and having cam slots cooperating with respective engaging pins carried by the other connector to produce a relative translation between the connectors in the relative engagement direction in response to translation of the slide in said transverse direction.

A lever hinged to the body of the first connector and connected to the slide provides for translating the slide and so reducing the force required to mate the connectors.

Known lever devices of the type briefly described above have several drawbacks.

In particular, to effectively reduce the force required, the resisting arm of the lever, i.e. the distance between the fixed hinge axis of the lever and the point of application of the thrust transmitted to the slide, must be conveniently small with respect to the power arm of the lever. On the other hand, a short resisting arm results in a small amount of translation of the slide and, hence, in an unfavourable transmission of forces between the slide and the other connector.

Alternatively, the efficiency of the lever device may be improved by increasing the length of the power arm or the angular travel of the lever. Such dimensions, however, being governed by overall size considerations, can only be increased to a certain extent.

Moreover, connection of the lever as described above results in severe frictional forces which considerably increase the manual force required to activate the lever.

It is an object of the present invention to provide an electric connector for a connecting unit of the type described above, designed to eliminate the aforementioned drawbacks typically associated with known connecting units.

According to the present invention, there is provided an electric connector of the type comprising an insulating casing having a number of cavities for respective electric terminals extending in a connection direction of said connector to a complementary connector; and a lever device for reducing the force required for connection to said complementary connector; said lever device comprising a slide sliding with respect to said casing in a direction perpendicular to said connection direction and having cam means interacting with said complementary connector to generate a force for mating said connectors in response to translation of said slide; and an activating lever for activating said slide and connected to the slide by first articulated connecting means, and to said casing by second articulated connecting means;

characterized in that both said first and said second articulated connecting means comprise a pair of hinge elements connected to each other in sliding manner to impart a translatory component of motion to said activating lever.

A preferred, non-limiting embodiment of the present invention will be described by way of example with reference to the accompanying drawings, in which.

Figure 1:
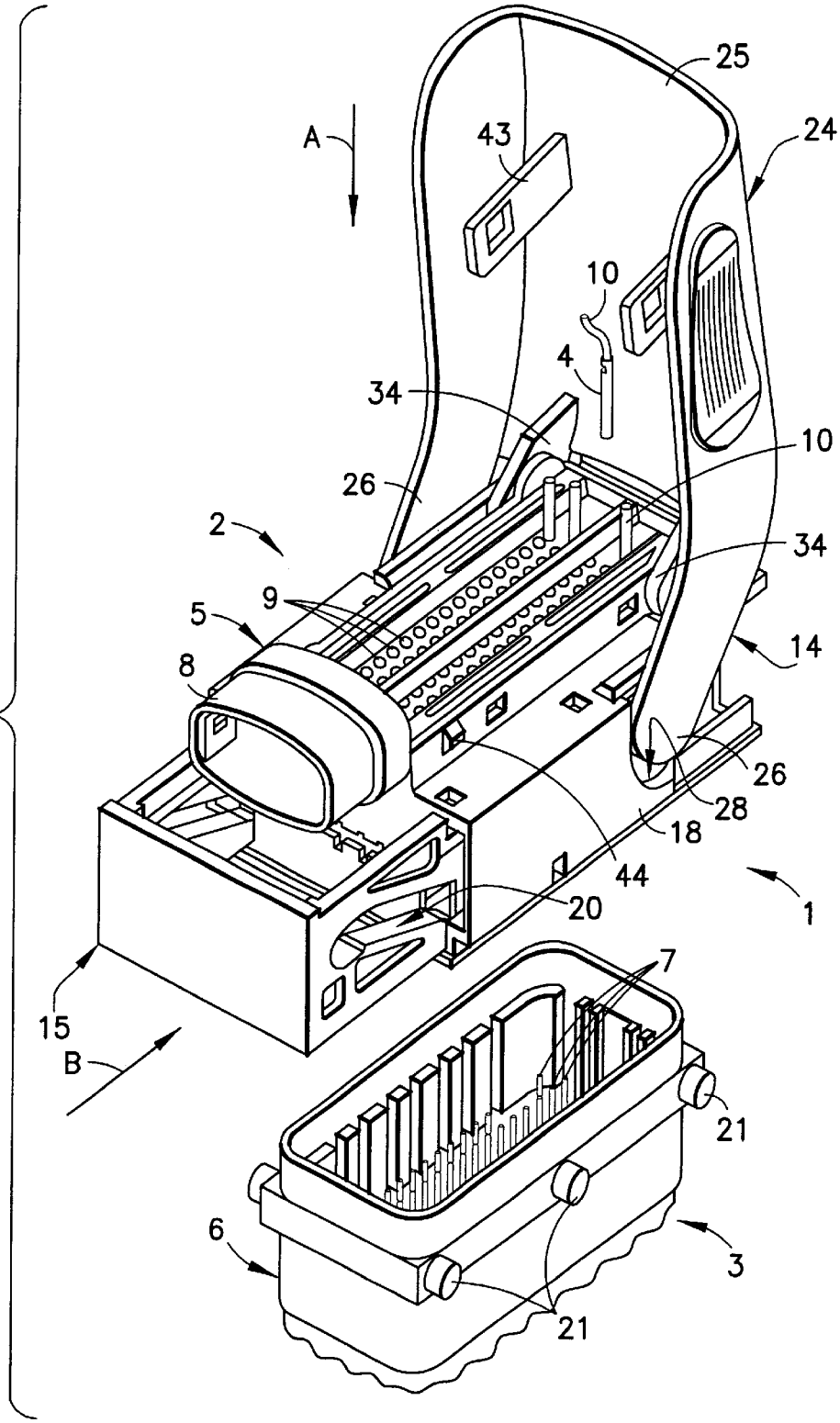
FIG. 1 shows a view in perspective of the component elements of a connecting unit in accordance with the present invention.
Figure 5:
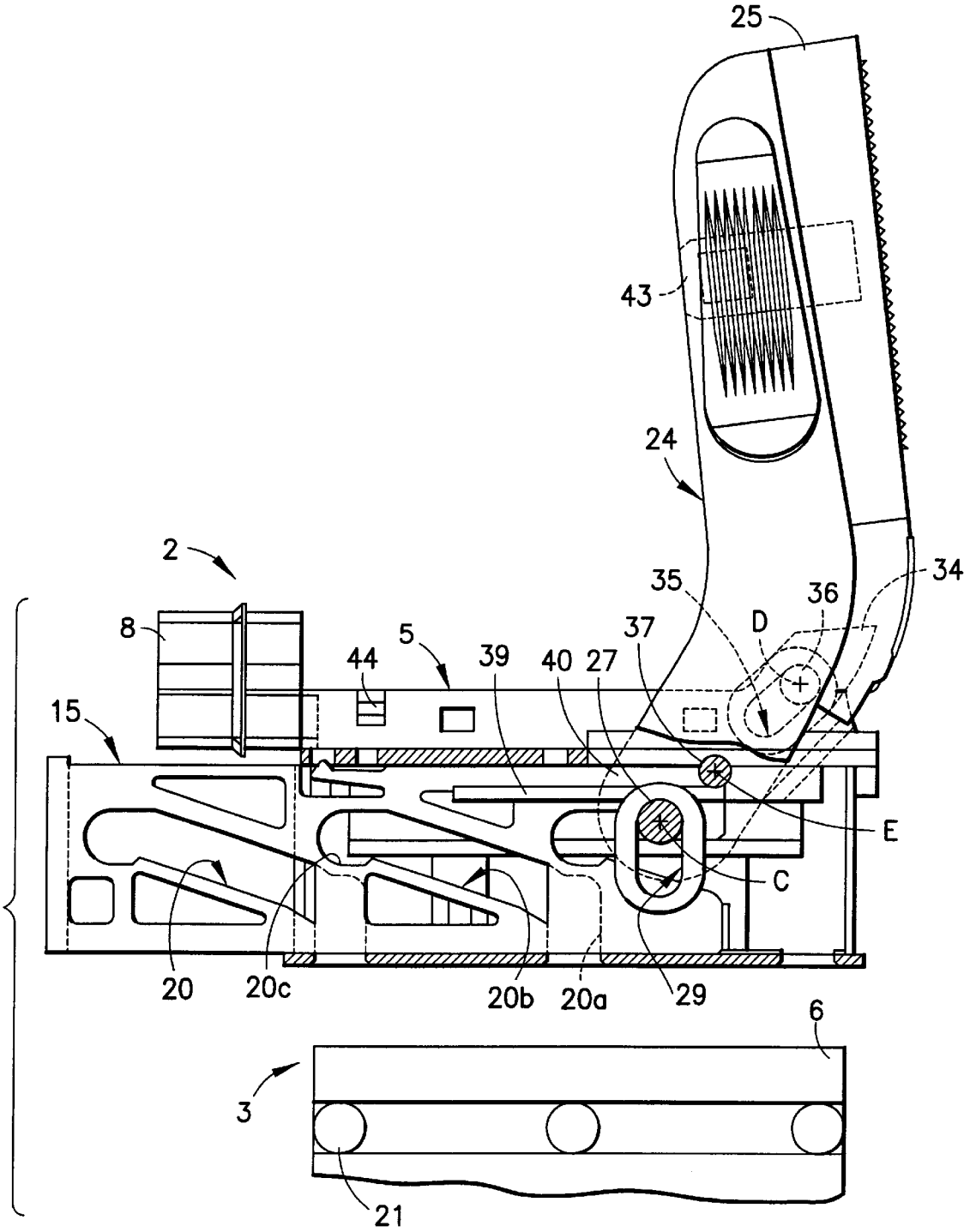
FIGS. 5, 6 and 7 show larger-scale side views of the FIG. 1 connecting unit in three different operating positions.

With reference to FIGS. 1 and 5, number 1 indicates as a whole an electric connecting unit, in particular for connecting an electronic central control unit (not shown) to a vehicle electric system.

Unit 1 substantially comprises a first plug connector 2 and a second socket connector 3 connectable to each other in a connection direction A. Connector 2 comprises an insulating casing 5 having a large number of cavities 6 extending parallel to direction A and for housing respective female electric terminals 4 (only one shown, withdrawn from the respective cavity, in FIG. 1); and connector 3 comprises an insulating casing 6 conveniently formed in one piece with the outer casing (not shown) of the electronic central control unit, and a number of male electric terminals 7 extending parallel to direction A.

Insulating casing 5 of connector 2 is substantially in the form of a hollow parallelepipedon, with a tubular lateral appendix 8 for guiding the cables 10 of respective electric terminals 4.

Finally, unit 1 comprises a lever device 14 permitting guided mating of first connector 2 and second connector 3 with little manual effort.

Figure 4:
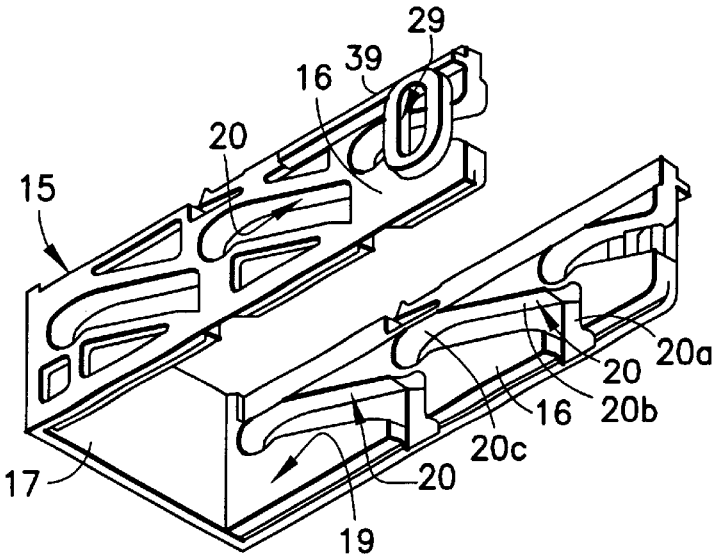
FIG. 4 shows an underside view in perspective of a third detail of the connector.

Device 14 substantially comprises a slide 15 (FIG. 4) movable inside and with respect to casing 5 in a direction B perpendicular to direction A. Slide 15 is substantially C-shaped, and comprises two substantially flat lateral walls 16 spaced apart and parallel to directions A and B, and a transverse end wall 17. Lateral walls 16 of slide 15 slide inside respective lateral walls 18 of casing 5, and define a cavity 19 for receiving, in use, insulating casing 6 of connector 3.

Each lateral wall 16 has a number of cam slots 20 which cooperate with respective pins 21 on the outside of casing 6 to produce an approach movement of connectors 2 and 3 in response to translation of slide 15 inwards of casing 5 in direction B. Each slot 20 comprises an input portion 20*a* parallel to direction A; an inclined intermediate portion 20*b*; and an end portion 20*c* parallel to direction B. More specifically (FIG. 4), the slots 20 close to the free ends of walls 16 have no input portions 20*a*, and the intermediate portions 20*b* terminate directly at said free ends.

Figure 2:
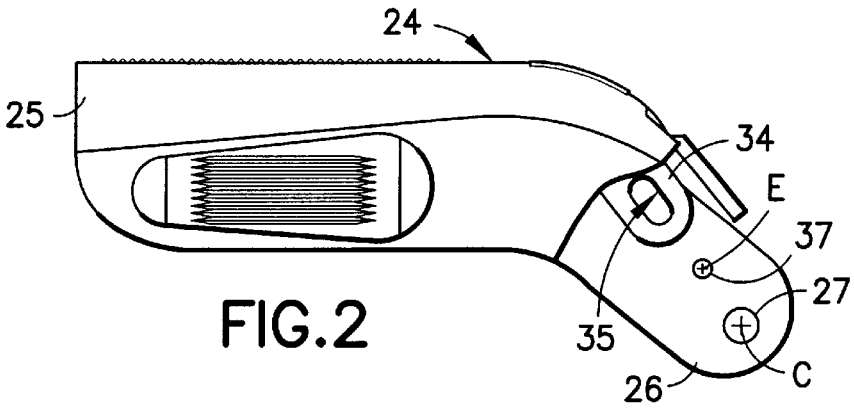
FIG. 2 shows a side view of a first detail of one connector of the FIG. 1 connecting unit.
Figure 3:
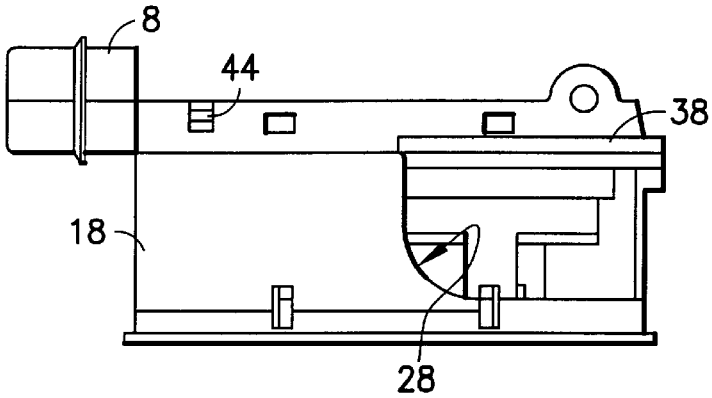
FIG. 3 shows a side view of a second detail of the connector.

Device 14 also comprises a first-class lever 24 (FIGS. 1 and 2) for activating slide 15, and which in turn comprises a substantially straight, elongated, C-section grip 25, and two lateral end arms 26.

Arms 26 comprise respective end pins 27 facing each other and defining an axis C of instantaneous rotation of lever 24 with respect to slide 15. Arms 26 extend on either side of casing 5, at respective openings 28 in the lateral walls 18 of casing 5, so that pins 27 engage in sliding manner respective slots 29 formed in respective end portions 30 of walls 16 of slide 15 and extending parallel to connection direction A.

Lever 24 also comprises two appendixes 34, which extend from grip 25 (FIGS. 1 and 2) in a direction substantially parallel to and on the inside of arms 26. Appendixes 34 have respective slots 35 elongated substantially radially with respect to axis C, and are engaged in sliding manner by respective pins 36 carried laterally by casing 5 and defining an axis D permitting articulation of lever 24 with respect to casing 5.

Arms 26 also comprise respective intermediate inner pins 37 of axis E parallel to and located in an intermediate position with respect to axes C and D. The top edges of lateral walls 16 of slide 15 have respective flanges 38 defining, with corresponding flanges 39 of casing 5, respective longitudinal guides 40 engaged in sliding manner by respective pins 37.

FIG. 5 shows lever 24 in the raised or open position, which corresponds to maximum projection of slide 15 from casing 5, and in which pins 36 engage the top ends of respective slots 35, lever 24 therefore has a maximum resisting arm, defined by the distance between axes C and D, and connector 2 may be mated with connector 3 so that pins 21 initially engage cam slots 20 of slide 15.

As of the above position, lever 24 may be rotated downwards (FIGS. 6 and 7) to translate slide 15 in direction B and so engage connectors 2, 3 and the respective electric terminals in direction A.

Figure 7:
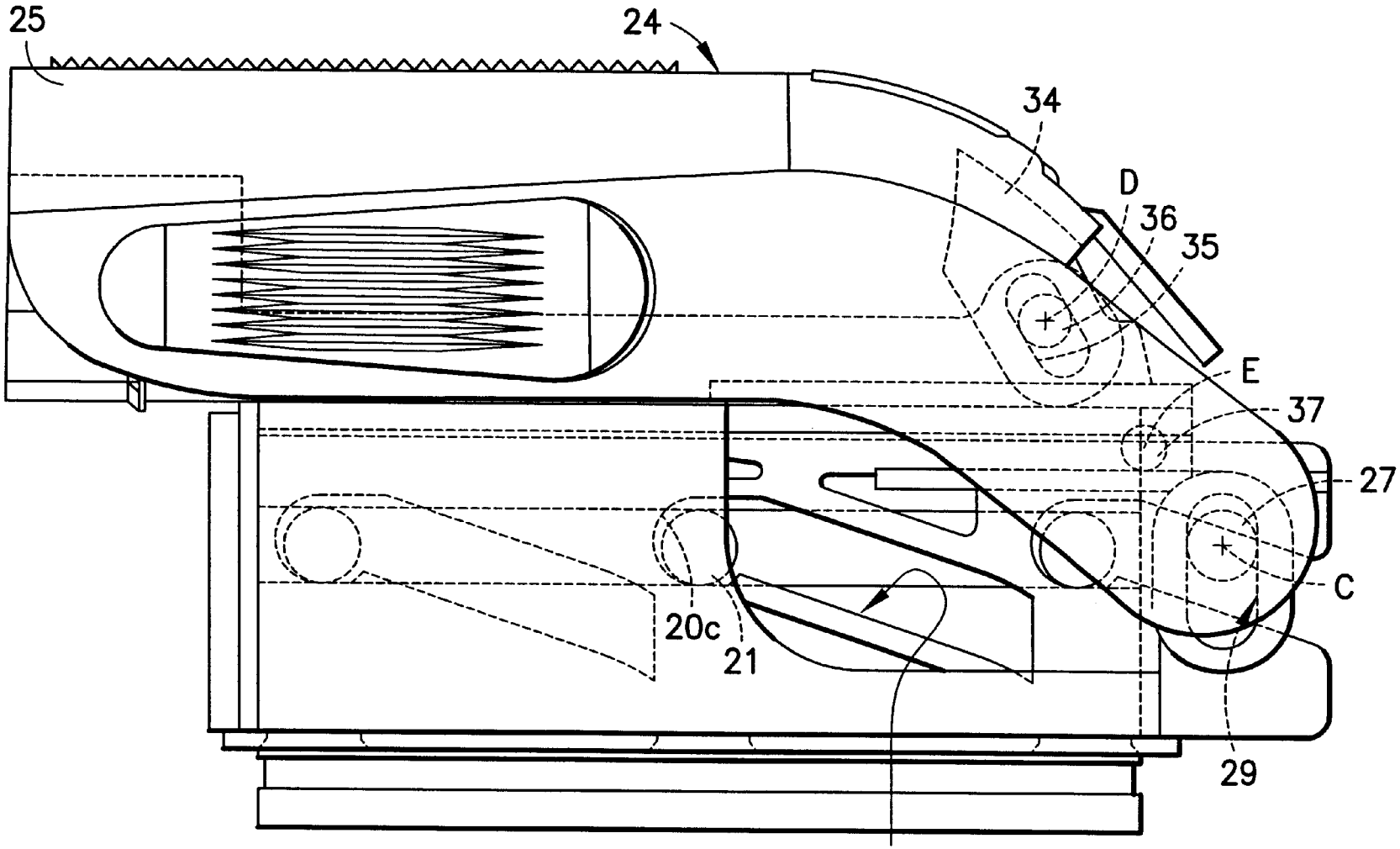

Lever 24 and casing 5 have conventional click-on fastening means (43, 44) to lock lever 24 releasably in the closed position shown in FIG. 7.

Figure 6:
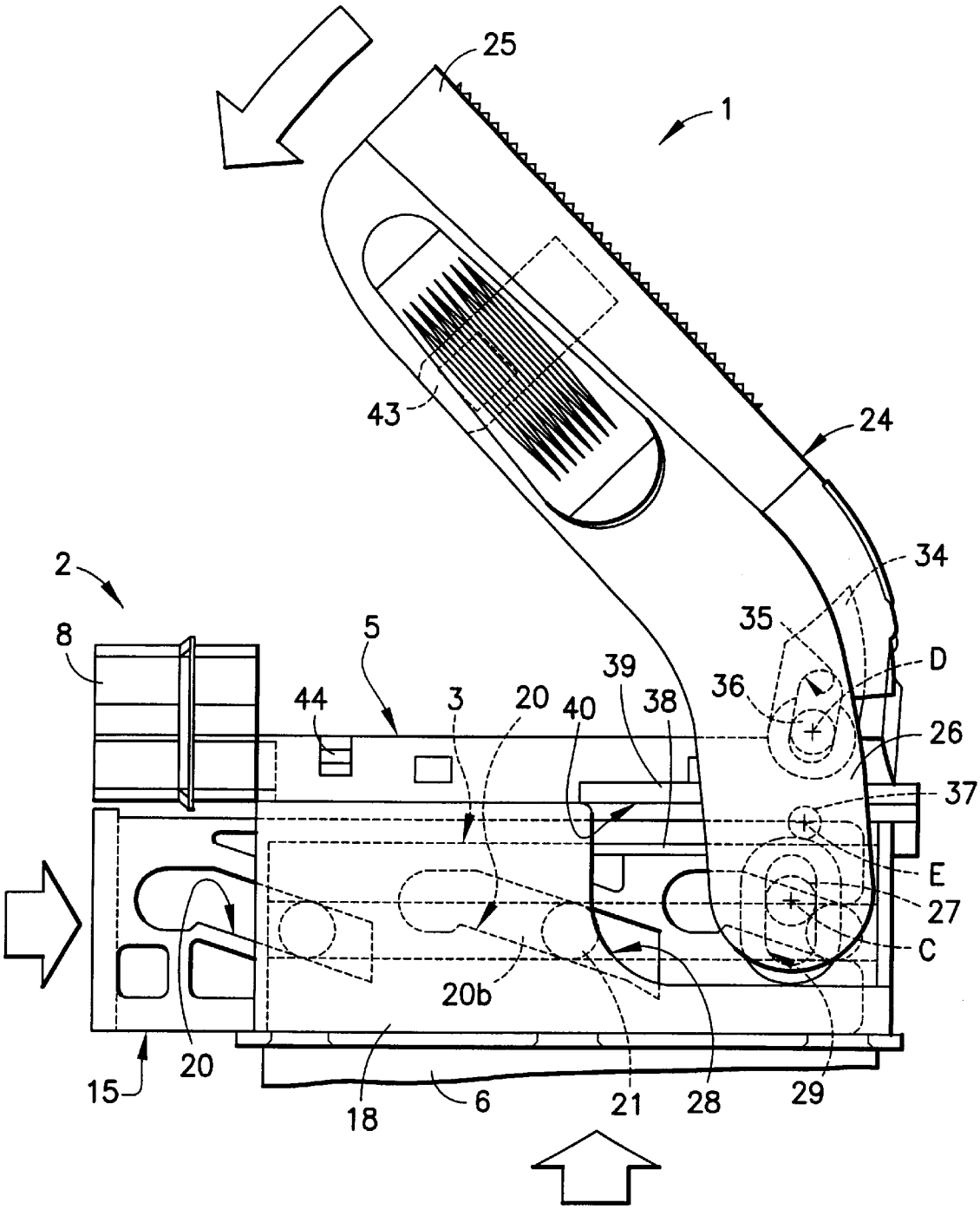

During the initial part of its rotation between the FIG. 6 and 7 positions, the motion of lever 24 has a radial component of translation with respect to axis D, in the direction defined by slots 35 and substantially upwards with reference to the Figures, so that pins 36 slide along and towards the bottom ends of respective slots 35 towards pins 27, and the distance between axes D and C, which defines the resisting arm of lever 24, decreases gradually to the minimum value corresponding to the FIG. 6 position.

At the same time, pins 21 interact with inclined intermediate portions 20*a* of cam slots 20, so that the intermediate stage in the rotation of lever 24 calls for overcoming the mating load of the connectors.

The final stage in the travel of lever 24 has a radial translation component in the opposite direction (i.e. towards axis C), and the resisting arm of lever 24 increases gradually until it is eventually restored to a relative maximum when pins 21 engage end portions 20*c*, parallel to direction B, of cam slots 20, which portions are reached when the connectors are fully mated.

At the start of rotation of lever 24, when the mating load is relatively low, the value of the resisting arm of lever 24 is therefore greater and corresponds to smaller load amplification but greater displacement of slide 15 per unit rotation of lever 24; at the intermediate stage in the rotation of lever 24, in which the mating load is maximum, the value of the resisting arm of lever 24 is lower and corresponds to greater load amplification to mate the connectors with very little manual effort; and at the final stage in the travel of lever 24, in which the load to be overcome is again low, the value of the resisting arm of lever 24 is again high, and corresponds to smaller load amplification but greater displacement of slide 15 per unit of rotation of lever 24.

The advantages of connector 2 according to the present invention will be clear from the foregoing description.

In particular, the movable-axis articulation between lever 24 and casing 5 provides for varying the resisting arm of the lever during its travel, and so effectively reducing the manual activating load while at the same time favourable transmitting motion to slide 15 to reduce the dimensions and angular travel of the lever.

Moreover, the "floating" arrangement of lever 24 reduces friction, thus further reducing the activating load.

Clearly, changes may be made to the connecting unit described without, however, departing from the scope of the accompanying Claims.

More specifically, lever device 14 may be carried by socket connector 3 as opposed to plug connector 2.

What is claimed is:

1. An electric connector (2) of the type comprising an insulating casing (5) having a number of cavities (10) for respective electric terminals (4) extending in a connection direction (A) of said connector (2) to a complementary connector (3); and a lever device (14) for reducing the force required for connection to said complementary connector (3); said lever device (14) comprising a slide (15) sliding with respect to said casing (5) in a direction (B) perpendicular to said connection direction (A) and having cam means (20) interacting with said complementary connector (3) to generate a force for mating said connectors (2, 3) in response to translation of said slide (15); and an activating lever (24) for activating said slide (15) and connected to the slide (15) by first articulated connecting means (27, 29), and to said casing (5) by second articulated connecting means (35, 36);

wherein both said first and said second articulated connecting means comprise a pair of hinge elements (27, 29; 35, 36) connected to each other in sliding manner to impart a translatory component of motion to said activating lever (24);

wherein said activating lever (24) is a first-class lever; said first and said second articulated connecting means (27, 29; 35, 36) being located respectively at an end portion (26) and an intermediate portion (34) of said activating lever (24); and wherein said activating lever (24) comprises at least a third pin (37) located in an intermediate position between said first and said second articulated connecting means (27, 29; 35, 36) and engaging in sliding manner a guide (40) defined by at least said slide (15) or said casing (5).

2. A connector as claimed in claim 1, characterized in that said guide (40) is parallel to the traveling direction (B) of said slide (15).

3. A connector as claimed in claim 1, characterized in that said guide (40) is defined by respective parallel flanges (38, 39) of said casing (5) and said slide (15).

4. An electric connector (2) of the type comprising an insulating casing (5) having a number of cavities (10) for respective electric terminals (4) extending in a connection direction (A) of said connector (2) to a complementary connector (3); and a lever device (14) for reducing the force required for connection to said complementary connector (3); said lever device (14) comprising a slide (15) sliding with respect to said casing (5) in a direction (B) perpendicular to said connection direction (A) and having cam means (20) interacting with said complementary connector (3) to generate a force for mating said connectors (2, 3) in response to translation of said slide (15); and an activating lever (24) for activating said slide (15) and connected to the slide (15) by first articulated connecting means (27, 29), and to said casing (5) by second articulated connecting means (35, 36);

wherein both said first and said second articulated connecting means comprise a pair of hinge elements (27, 29; 35, 36) connected to each other in sliding manner to impart a translatory component of motion to said activating lever (24); and wherein each said pair of hinge elements (27,29) comprises a first pin (27) engaging in a sliding manner a first elongated slot (29) and each pair of hinge elements (35, 36) comprise a second pin (36) engaging in a sliding manner a second elongated slot (35).

5. A connector as claimed in claim 10, wherein said first pin (27) and said second slot (35) are carried by said activating lever (24); in that said first slot (29) is carried by said slide (15); and in that said second pin (36) is carried by said casing (5).

6. An electric connector (2) of the type comprising an insulating casing (5) having a number of cavities (10) for respective electric terminals (4) extending in a connection direction (A) of said connector (2) to a complementary connector (3); and a lever device (14) for reducing the force required for connection to said complementary connector (3); said lever device (14) comprising a slide (15) sliding with respect to said casing (5) in a direction (B) perpendicular to said connection direction (A) and having cam means (20) interacting with said complementary connector (3) to generate a force for mating said connectors (2, 3) in response to translation of said slide (15); and an activating lever (24) for activating said slide (15) and connected to the slide (15) by first articulated connecting means (27, 29), and to said casing (5) by second articulated connecting means (35, 36);

wherein both said first and said second articulated connecting means comprise a pair of hinge elements (27, 29; 35, 36) connected to each other in sliding manner to impart a translatory component of motion to said activating lever (24);

said hinge elements (27, 29) of said first articulated connecting means comprising at least a first pin (27) defining a first hinge axis (C) and engaging in sliding manner a respective first slot (29) elongated in a direction substantially parallel to said connection direction (A); said hinge elements (35, 36) of said second articulated connecting means comprising at least a second pin (36) defining a second hinge axis (D) and engaging in sliding manner a respective second slot (35); said first and said second pin (27, 36) respectively engaging said first and said second slot (29, 35) in sliding manner to vary the distance between said first and said second hinge axis (C, D) along the path of said activating lever (24); and wherein said second slot (35) is an elongated slot.

7. A connector as claimed in claim 6 wherein said second slot (35) is elongated in a substantially radial direction with respect to said first hinge axis (C).

* * * * *

UNITED STATES PATENT AND TRADEMARK OFFICE

CERTIFICATE OF CORRECTION

PATENT NO. : 6,345,995 B1
DATED : February 12, 2002
INVENTOR(S) : Bigotto et al.

It is certified that error appears in the above-identified patent and that said Letters Patent is hereby corrected as shown below:

Title page,
Item [30], the Foreign Application Priority date should read
-- November 27, 1998 --.

Column 5,
Line 19, delete "claim 10" and insert -- claim 4 --.

Signed and Sealed this

Eleventh Day of February, 2003

JAMES E. ROGAN
*Director of the United States Patent and Trademark Office*